US010485729B2

(12) United States Patent
Jones

(10) Patent No.: US 10,485,729 B2
(45) Date of Patent: Nov. 26, 2019

(54) EXERCISE DEVICE

(71) Applicant: COULTER VENTURES LLC, Columbus, OH (US)

(72) Inventor: Dylan Jones, Columbus, OH (US)

(73) Assignee: COULTER VENTURES LLC, Columbus, OH (US)

( * ) Notice: Subject to any disclaimer, the term of this patent is extended or adjusted under 35 U.S.C. 154(b) by 0 days.

(21) Appl. No.: 15/713,897

(22) Filed: Sep. 25, 2017

(65) Prior Publication Data

US 2018/0008508 A1 Jan. 11, 2018

Related U.S. Application Data

(63) Continuation of application No. 14/275,635, filed on May 12, 2014, now Pat. No. 9,801,781.
(Continued)

(51) Int. Cl.
*A61H 15/00* (2006.01)
*A61H 7/00* (2006.01)
(Continued)

(52) U.S. Cl.
CPC ..... *A61H 15/0092* (2013.01); *A61H 7/001* (2013.01); *A61H 15/00* (2013.01);
(Continued)

(58) Field of Classification Search
CPC . A63B 21/0004; A63B 22/0046; A63B 22/18; A63B 26/003; A63B 2023/006; A63B 43/00; A63B 45/00; A61H 1/008; A61H 2201/1284; A61H 2201/1623; A61H 2201/1695; A61H 2201/1685; A61H 2201/0161; A61H 2201/0167; A61H 2201/0107; A61H 2201/01; A61H 15/00; A61H 15/0092; A61H 2015/0007; A61H 2015/0014; A61H 2015/0021; A61H 2015/0042; A61H 2015/005; A61H 2015/0057; A61H 2015/0064; A61H 2015/0071; A61H 2205/081;
(Continued)

(56) References Cited

U.S. PATENT DOCUMENTS 896,484 A * 8/1908 Thoms ..... A61H 15/0092 601/120
3,705,579 A * 12/1972 Morini ..... A61H 15/00 601/121
(Continued)

FOREIGN PATENT DOCUMENTS

AT 6201 U1 6/2003
DE 202004016622 U1 3/2005
(Continued)

OTHER PUBLICATIONS

EP Application No. 14 168 044.7 Search Report dated Oct. 2, 2014.

*Primary Examiner* — Joshua Lee
(74) *Attorney, Agent, or Firm* — Vorys, Sater, Seymour and Pease LLP; William L. Klima

(57) ABSTRACT

A exercise roller device including a center roller portion provided with shaped end roller portions, and the center roller portion provided with a centered circumferential groove. A method of making the exercise roller device.

12 Claims, 10 Drawing Sheets

Related U.S. Application Data

(60) Provisional application No. 61/822,697, filed on May 13, 2013.

(51) Int. Cl.
*A63B 23/00* (2006.01)
*A61H 1/00* (2006.01)

(52) U.S. Cl.
CPC ..... *A63B 23/00* (2013.01); *A61H 1/008* (2013.01); *A61H 2015/0021* (2013.01); *A61H 2201/1284* (2013.01); *A61H 2201/1623* (2013.01); *A61H 2201/1695* (2013.01); *A61H 2203/0456* (2013.01); *A61H 2205/081* (2013.01); *A63B 2023/006* (2013.01)

(58) Field of Classification Search
CPC ..... A61H 2203/0456; A61H 7/001; A61H 2205/08; A63F 2009/124
USPC ..... 482/132
See application file for complete search history.

(56) References Cited

U.S. PATENT DOCUMENTS 3,863,923 A * 2/1975 Anderson ..... A63B 39/06 40/327
4,050,184 A * 9/1977 Chiari ..... A63H 33/101 273/157 R
4,785,800 A * 11/1988 Stilson ..... A61H 15/00 601/121
4,945,900 A * 8/1990 Masuda ..... A61H 15/0092 601/120
5,131,383 A * 7/1992 Juarez ..... A61H 15/00 601/121
5,170,778 A * 12/1992 Jamis ..... A61H 15/00 601/121
5,389,063 A * 2/1995 Wu ..... A61H 7/001 273/153 S
5,577,995 A * 11/1996 Walker ..... A61H 15/0092 601/118
5,637,065 A 6/1997 Chang
6,299,585 B1 * 10/2001 Yoo ..... A61H 7/001 601/118
6,302,815 B1 * 10/2001 Shishido ..... A63B 41/08 473/598
6,419,650 B1 * 7/2002 Ryan ..... A61H 15/00 601/122
6,805,350 B1 * 10/2004 Wu ..... A63B 43/00 273/156
6,974,427 B1 * 12/2005 Lapham ..... A61H 15/00 601/120
D546,402 S 7/2007 Sonnier
7,250,032 B2 * 7/2007 Fink ..... A61H 1/0292 601/118
7,479,097 B2 * 1/2009 Rosborough ..... A63B 22/16 446/396
7,517,324 B2 * 4/2009 Cohen ..... A61H 7/001 601/135
8,926,482 B2 1/2015 Miller, Jr.
9,550,088 B2 1/2017 Coompol
2005/0176565 A1 8/2005 Dua et al.
2006/0089578 A1 * 4/2006 Hsu ..... A61H 15/00 601/118
2007/0037642 A1 * 2/2007 Chang ..... A63B 41/08 473/604
2007/0225133 A1 * 9/2007 Castro ..... A63B 21/0004 482/140
2008/0103421 A1 * 5/2008 Nicholson ..... A61H 15/0092 601/120
2009/0325747 A1 * 12/2009 Ou ..... A63B 41/08 473/605
2010/0301558 A1 * 12/2010 Speegle ..... A63F 9/12 273/153 S
2011/0256967 A1 * 10/2011 Shore ..... A63B 43/00 473/595
2011/0257569 A1 * 10/2011 Robins ..... A61H 15/00 601/137
2011/0300995 A1 12/2011 Castiglione
2012/0329587 A1 * 12/2012 Ou ..... A63B 41/08 473/605
2013/0072357 A1 3/2013 Galvan
2013/0096472 A1 4/2013 Bertram et al.
2013/0139797 A1 * 6/2013 Oblack ..... F41B 3/04 124/5
2013/0184620 A1 * 7/2013 Cohen ..... A61H 15/0092 601/118
2014/0274465 A1 * 9/2014 Francis ..... A63B 43/00 473/351

FOREIGN PATENT DOCUMENTS

FR 2083711 A5 12/1971
WO 0119314 A1 3/2001
WO 2005013882 A1 2/2005

* cited by examiner

EXERCISE DEVICE

RELATED APPLICATION(S)

This U.S. Patent Application claims benefit under 35 U.S.C. 119(e) of U.S. Provisional Application No. 61/822,697, filed on May 13, 2013, the content of which is hereby incorporated by reference in its entirety.

FIELD

An exercise device, in particular an exercise roller device comprising an inner roller supporting and an outer roller. The inner roller can be substantially rigid and the outer roller can be soft or resiliently deformable.

BACKGROUND

In the past, various types of rolling devices are used as exercise roller devices. A person can exercise using the exercise roller device in many different ways to exercise.

SUMMARY

An improved exercise device.

An improved exercise roller device.

A composite exercise roller device.

An exercise roller device comprising or consisting of an inner roller supporting and outer roller.

An exercise roller device comprising or consisting of an inner roller supporting one or more outer roller panels defining an outer roller.

An exercise roller device comprising or consisting of a substantially rigid inner roller connected to one or more soft or resiliently deformable outer roller.

An exercise roller device comprising or consisting of a substantially rigid inner roller connected to one or more soft or resiliently deformable outer roller panels.

An exercise roller device comprising or consisting of a substantially rigid inner roller supporting a soft or resiliently deformable outer roller.

An exercise roller device comprising or consisting of a substantially rigid inner roller connected to one or more soft or resiliently deformable outer roller panels.

An exercise roller device comprising or consisting of an inner roller supporting multiple outer roller panels.

An exercise roller device comprising or consisting of a substantially rigid inner roller supporting multiple soft or resiliently deformable outer roller panels An exercise roller device comprising or consisting of an inner roller supporting an outer roller, the inner roller comprising an inner roller shell.

An exercise roller device comprising or consisting of an inner roller supporting an outer roller, the inner roller comprising an inner roller shell and one more interior reinforcing members configured to reinforce the inner roller shell.

An exercise roller device comprising or consisting of a substantially rigid inner roller supporting a soft or resiliently deformable outer roller, the inner roller comprising an inner roller shell and one more interior reinforcing members configured to reinforce the inner roller shell.

An exercise roller device comprising or consisting of a substantially rigid inner roller supporting a soft or resiliently deformable outer roller, the inner roller comprising a substantially rigid inner roller shell and one more interior reinforcing members configured to reinforce the inner roller shell.

An exercise roller device comprising or consisting of an inner roller supporting an outer roller, the inner roller comprising two or more inner roller portions.

An exercise roller device comprising or consisting of a substantially rigid inner roller supporting a soft or resiliently deformable outer roller, the inner roller comprising two or more inner roller portions.

An exercise roller device comprising or consisting of an inner roller supporting an outer roller, the inner roller comprising a two or more inner roller portions connected together.

An exercise roller device comprising or consisting of a substantially rigid inner roller supporting a soft or resiliently deformable outer roller, the inner roller comprising two or more inner roller portions connected together.

An exercise roller device comprising or consisting of an inner roller supporting an outer roller, the inner roller comprising a pair of one-half roller portions connected together.

An exercise roller device comprising or consisting of a substantially rigid inner roller supporting a soft or resiliently deformable outer roller, the inner roller comprising a pair of one-half inner roller portions connected together.

An exercise roller device comprising or consisting of an inner roller supporting an outer roller, the inner roller comprising a pair of one-half inner roller portions connected together, the inner roller portions comprising one or more longitudinal interior ribs and one or more transverse interior ribs.

An exercise roller device comprising or consisting of a substantially rigid inner roller supporting a soft or resiliently deformable outer roller, the inner roller comprising a pair of one-half roller portions connected together, the roller portions comprising one or more longitudinal interior ribs and one or more transverse interior ribs.

An exercise roller device comprising or consisting of a center roller portion and a pair of nose cone-shaped end roller portions connected together.

An exercise roller device comprising or consisting of a center roller portion and a pair of nose cone-shaped end roller portions connected together, the center roller portion comprising a center V-shaped circumferential groove.

An exercise roller device comprising or consisting of an inner roller supporting two or more outer roller panels.

An exercise roller device comprising or consisting of an inner roller supporting two or more outer roller panels defining at least a portion of an outer surface of the exercise roller device.

An exercise roller device comprising or consisting of an inner roller supporting two or more outer roller panels defining an entire outer surface of the exercise roller device.

A method of making an exercise roller device comprising making an outer roller; making an inner roller, and assembling the inner roller within the outer roller.

A method of making an exercise roller device comprising making an inner roller; and overmolding an outer roller on the inner roller.

A method of making an exercise roller device comprising making an inner roller comprising two or more inner roller portions; assembling the inner roller; and assembling an outer roller on the inner roller.

A method of making an exercise roller device comprising making an inner roller comprising two or more inner roller portions; and overmolding an outer roller on the assembled inner roller.

A method of making an exercise roller device comprising injection molding an inner roller, inserting the inner roller in a mold; and overmolding an outer roller on the inner roller.

A method of making an exercise roller device comprising injection molding two or more portions of an inner roller; assembling the inner roller; inserting the inner roller in a mold; and overmolding an outer roller on the inner roller.

A method of making an exercise roller device comprising injection molding two half portions of an inner roller; assembling the two half portions together; inserting the inner roller in a mold; and overmolding an outer roller on the inner roller.

The exercise roller device comprises or consists of a roller. The roller can be hard, soft, resiliently deformable, or combination thereof. For example, the roller comprises a substantially stiff inner roller and a resilient or soft outer roller.

The exercise roller device can comprise a center cylindrical center portion and nose cone-shape end portions connected together. The roller can include a V-shaped center portion, modified V-shape center portion, U-shaped center portion, modified U-shape center portion (e.g. a circumferential groove).

The exercise roller device can comprise an inner roller supporting (e.g. connected to, layered, covered by) an outer roller. The inner roller can be substantially rigid, and the outer roller can be soft or resilient (e.g. resiliently deformable).

The outer roller can comprise or consist of one or more outer roller panels supported (e.g. connected to, layered, overmolded) by the inner roller. The one or more outer roller panels can be soft or resiliently deformable (e.g. made of thermoplastic elastomer material).

The inner roller can have a solid construction (e.g. solid injection molded part or component) or a non-solid construction (e.g. molded with separated layers, voids, cells, cavities). For example, the inner roller comprises two or more parts or components connected or assembled together. For example, the inner roller comprises two molded halves (e.g. injection molded) that are solid, or comprise voids, cells, or cavities. For example, the inner roller comprises a shell along with one or more interior longitudinal ribs and one or more transverse ribs (e.g. injection molded nylon material halves with one or more longitudinal ribs and multiple transverse ribs interconnected to or integrate with the shell). The two halves are connected together (e.g. by adhering or mechanically fastening or coupling together (e.g. one or more screws) to form an assembled inner roller. One of the halves can be provided with a raised perimeter flange cooperating with a perimeter groove in the other half to guide and strengthen the perimeter connection between the two halves. At a junction, for example, between a center longitudinal rib and a transverse rib, a round anchoring screw receptacle is molded to anchor end(s) of the screw(s) for assembling the halves together.

The inner roller can be provided with a circumferential rib (e.g. wide rib) provided at the center of the circumferential groove. A pair of outer roller panels connect to the inner roller and abut the wide rib so that the outer surface of the exercise roller device is defined by the exterior surfaces of the outer roller panels and the exterior surface of the wide rib. Alternatively, the rib is eliminated, and the two outer roller panels abut each other and the exterior surfaces of the two outer roller panels define the entire exterior surface of the exercise roller device.

The exercise roller device can comprise or consist of an inner roller portion and an outer roller portion. For example, the exercise roller device comprises a substantially rigid inner roller portion supporting a soft or resiliently deformable outer roller portion. The outer roller portion can comprise one or more panels. The outer roller portion can comprise multiple panels that can be of the same size and shape, or can be of a different size and/or shape. The shape of the exercise roller device comprises a roller portion that can be cylindrical-shaped, modified cylindrical-shaped (e.g. oval and/or oblong-shaped transverse cross-sectional shape), multi-sided transverse cross-sectional shape (e.g. triangle, square, pentagon, hexagon, heptagon, octagon, more than eight sided).

The inner roller can be a substantially rigid inner roller. For example, the roller is made of plastic, nylon, or composite material (e.g. injection molded plastic article). Alternatively, the inner roller can be machined from a pre-form or block of material (e.g. plastic pre-form or block of plastic material).

The exercise roller device can comprise an inner roller and at least one outer roller panel supported by the inner roller. For example, the outer roller panel or panels can be made separately, and then applied or assembled to the inner roller (e.g. by adhering and/or mechanically coupling). Alternatively, the at least one outer roller panel can be formed on the inner roller (e.g. insert molding, overmolding).

The outer roller panel or panels can each be made as a single piece, or can be made of multiple pieces joined together (e.g. molded, adhered, mechanically coupled, or combination thereof). For example, the outer roller panels can each be made with a inner support panel (e.g. made of nylon) and an outer cover panel made of resilient deformable material (e.g. thermoplastic elastomer). The panel or panels can be smooth or textured (e.g. pattern of projections, ribs, recesses, grooves). For example, the panel or panels can be molded from thermoplastic elastomer (TPE) material.

The exercise roller device can be used as a self-massaging tool to facilitate manipulation of the cerebral vertebrae. The exercise roller device can be used as a stretch device by roller backward and forward.

DETAILED DESCRIPTION

Figure 1:
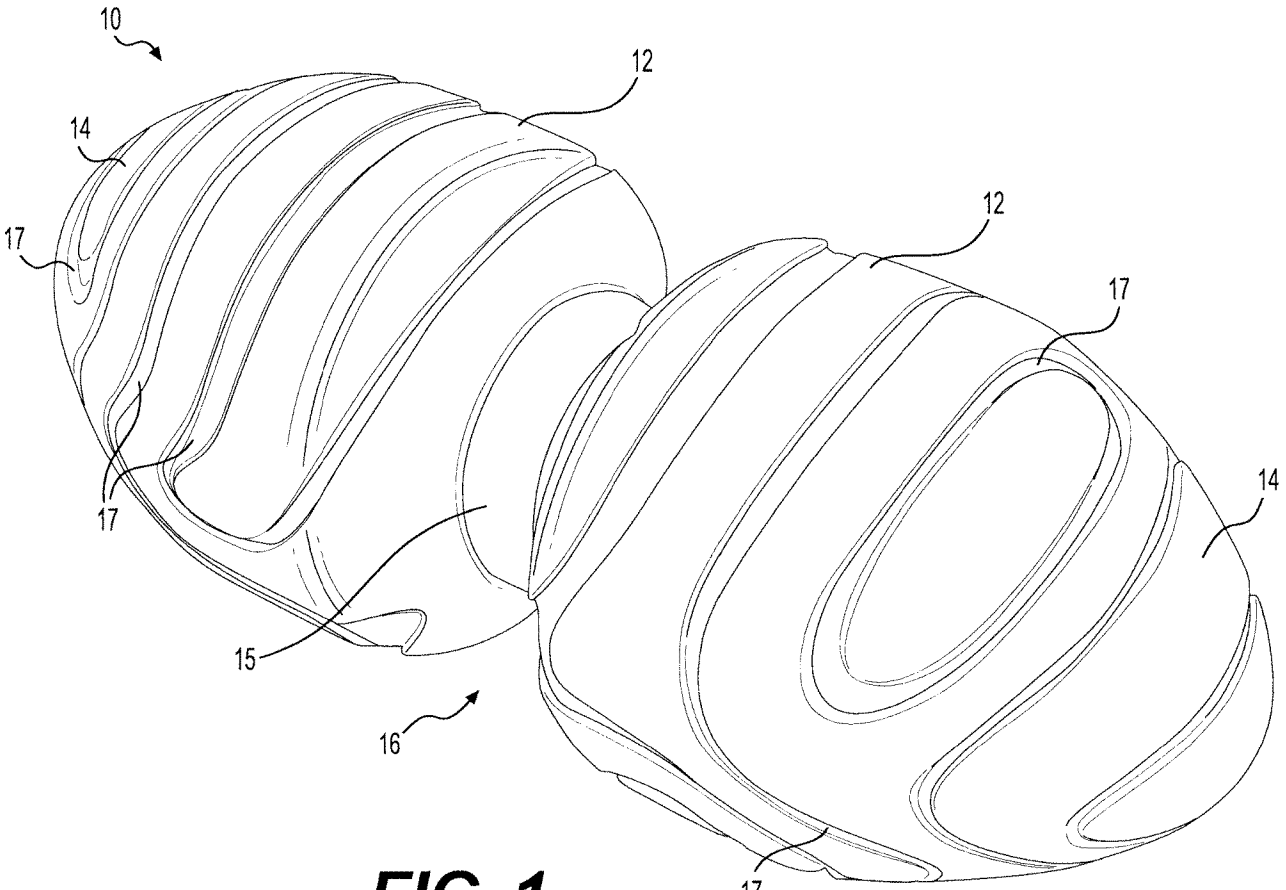
FIG. 1 is a perspective view of an exercise roller device.
Figure 2:
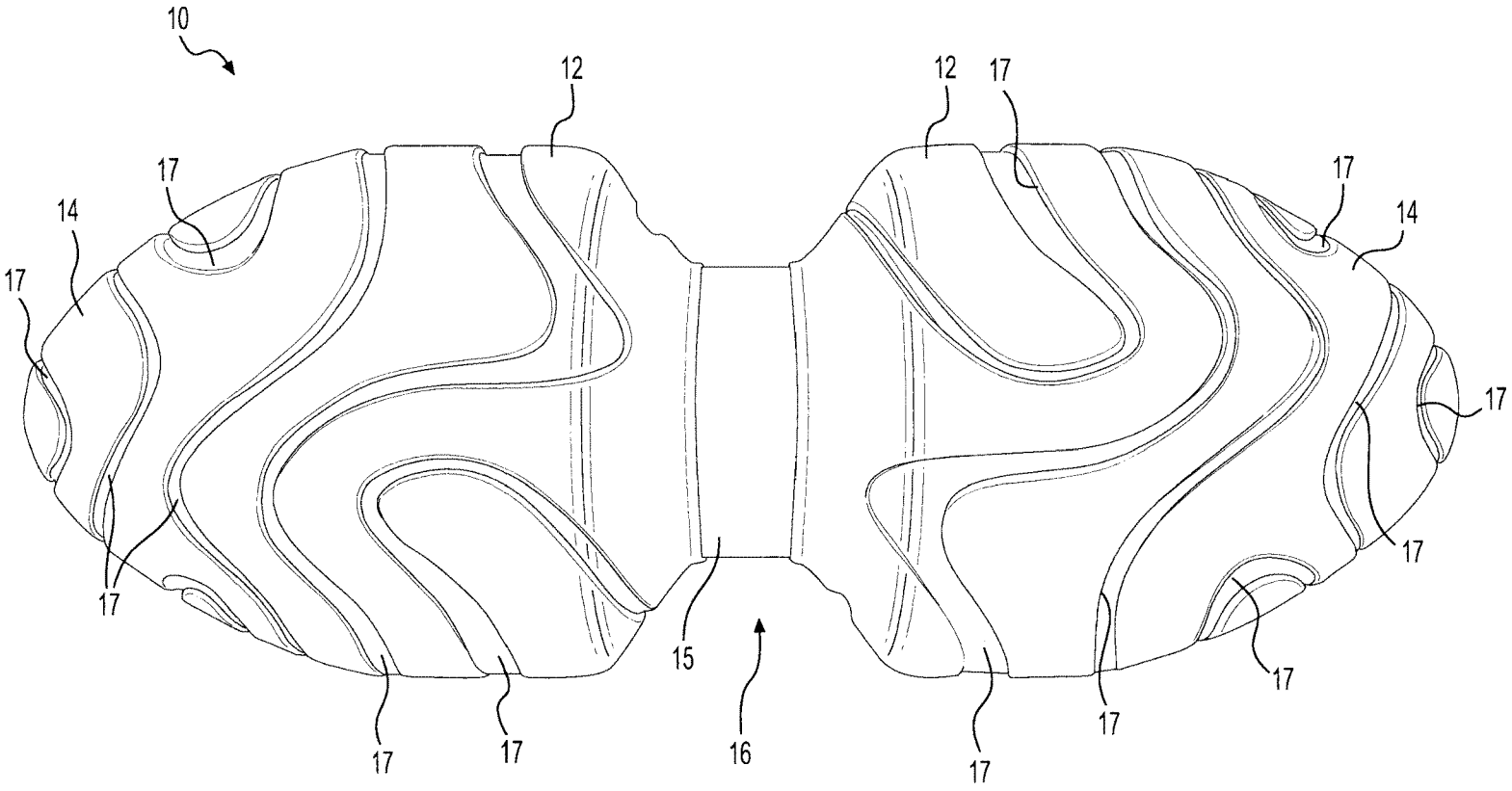
FIG. 2 is a front elevational view of the exercise roller device shown in FIG. 1.
Figure 3:
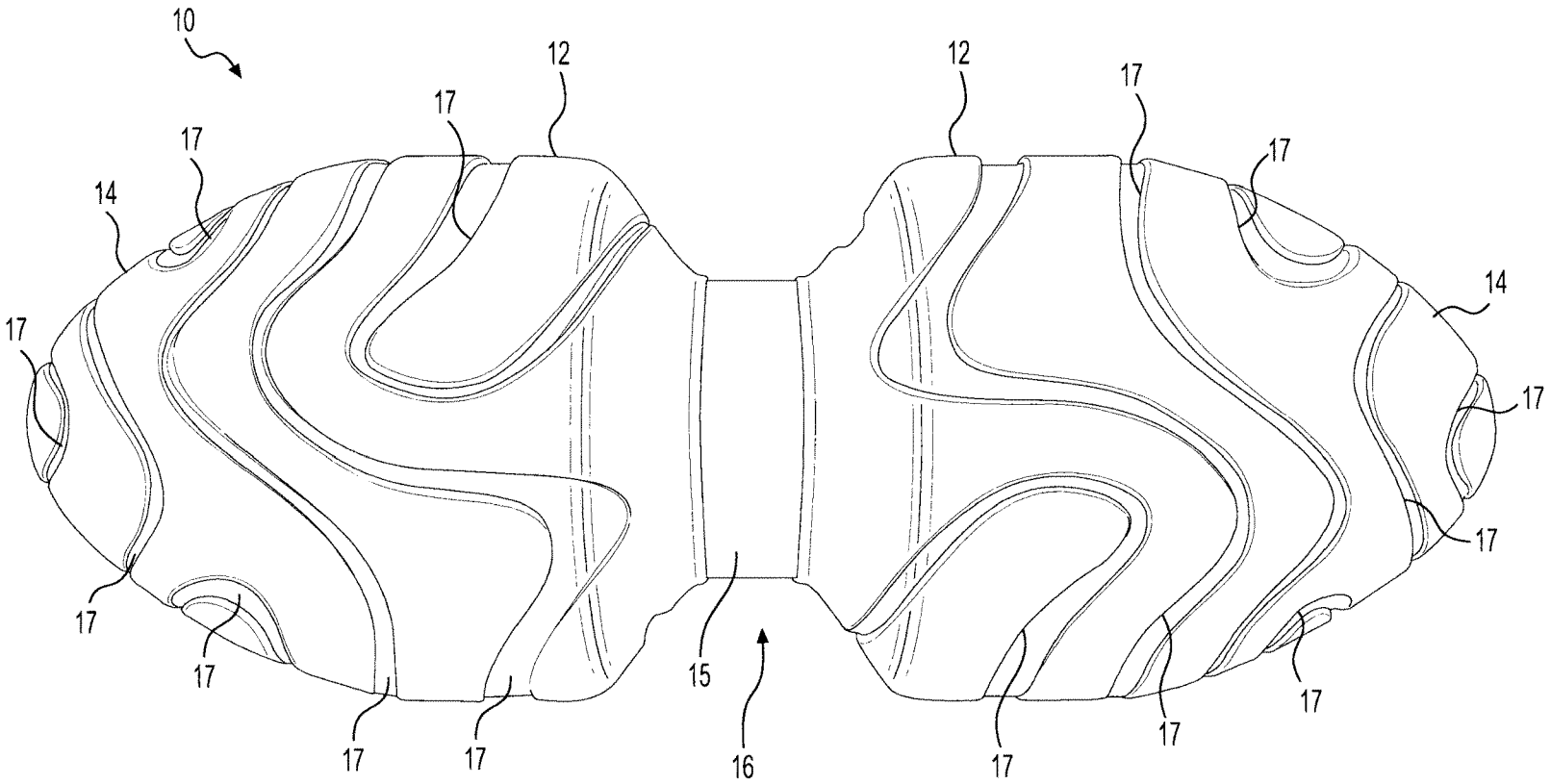
FIG. 3 is a rear elevational view of the exercise roller device shown in FIG. 1.
Figure 4:
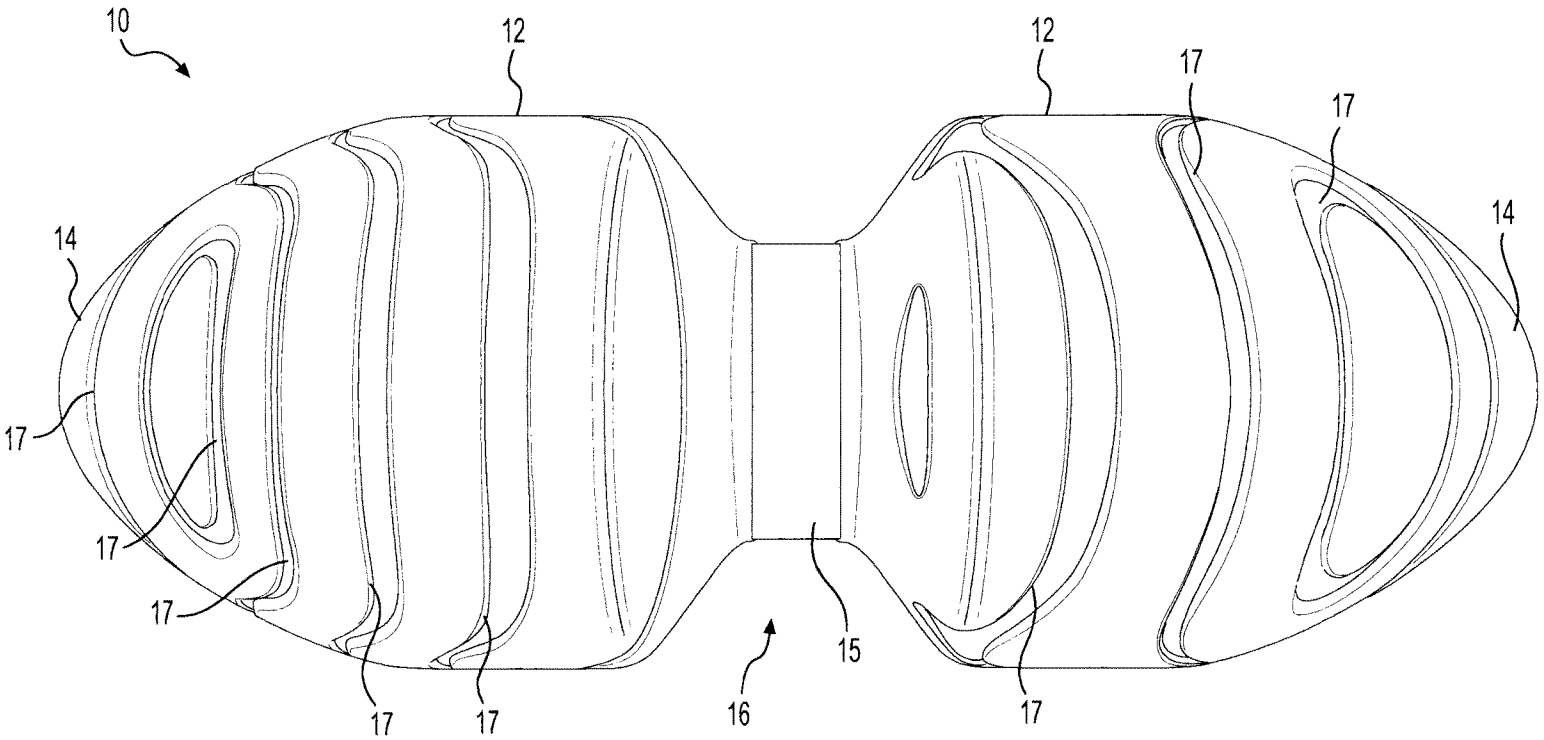
FIG. 4 is a top planar view of the exercise roller device shown in FIG. 1.
Figure 5:
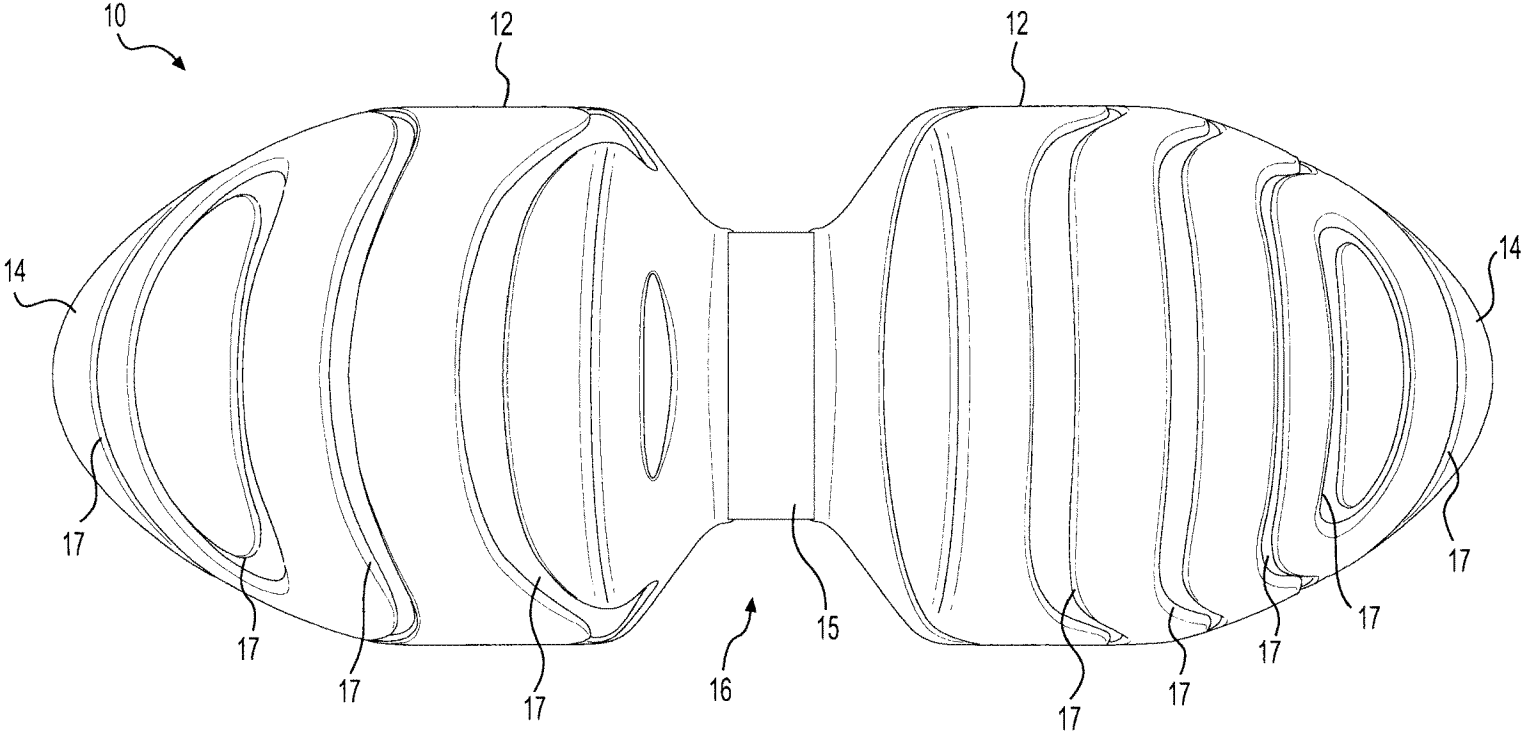
FIG. 5 is a bottom planar view of the exercise roller device shown in FIG. 1.
Figure 6:
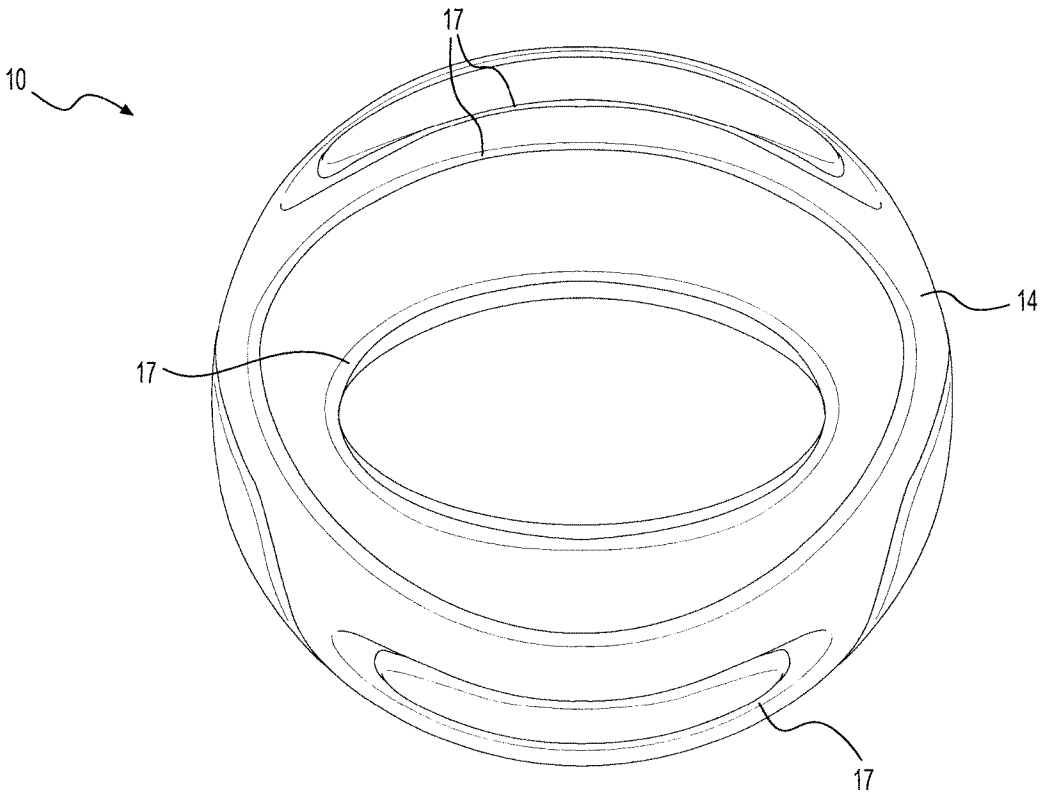
FIG. 6 is a left side elevational view of the exercise roller device shown in FIG. 1.
Figure 7:
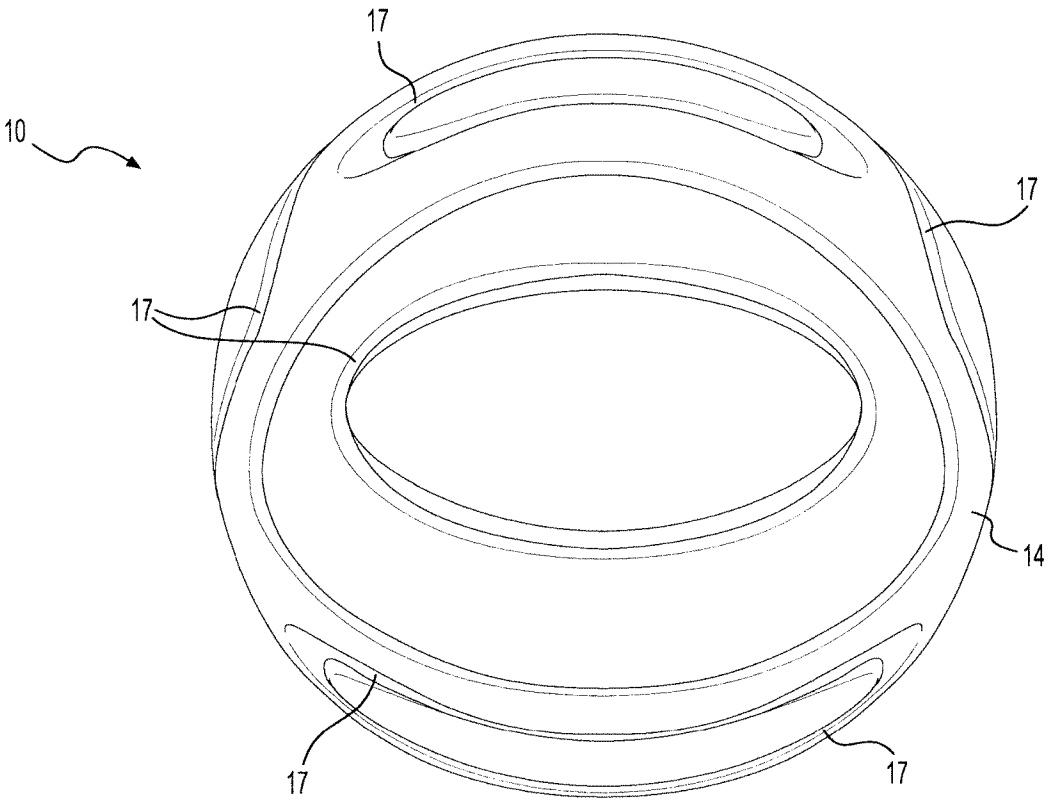
FIG. 7 is a right side elevational view of the exercise roller device shown in FIG. 1.

An exercise roller device 10 is shown in FIG. 1 thru 7. The exercise roller device 10 comprises a cylindrical-shaped center roller portion 12 and end roller portions 14, which can have a particular shape (e.g. cylindrical-shaped, parabolic-shaped, nose cone-shaped). The center roller portion 12 can be provided with a centered cylindrical-shaped portion 15 located within a circumferential groove 16 (e.g. V-shaped, modified V-shaped, U-shaped, modified U-shaped groove 16). The cylindrical-shaped center roller portion 12 can be of a greater diameter compared with the centered cylindrical-shaped portion 15.

The surface of the exercise roller device 10 is provided with a pattern of grooves 17 as shown. The grooves 17 can be closed-looped (e.g. circles, ovals, modified ovals), or can be open-looped (e.g. curves, straight portions). The pattern of grooves can be located in the surface of the outer roller (e.g. in a first surface layer only, in first and second surface layers, or deeper) of the exercise roller device 10. The grooves 17 are shown as being a pattern of separated and/or spaced apart grooves.

Figure 8:
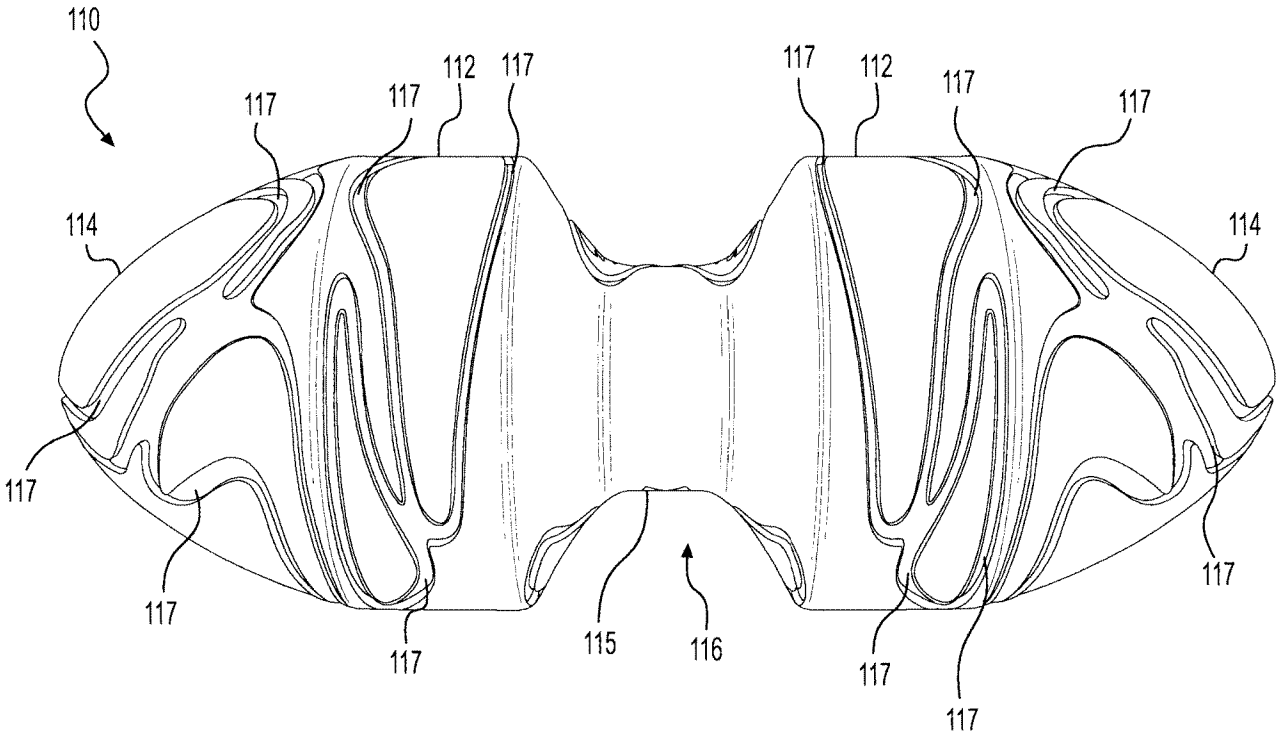
FIG. 8 is a perspective view of another exercise roller device.

Another exercise device 110 is shown in FIG. 8. The exercise roller device 110 comprises a cylindrical-shaped center roller portion 112 and end roller portions 114 having particular shape (e.g. cylindrical, parabolic-shaped, nose cone-shaped). The center roller portion 112 is provided with a cylindrical portion 115 located within a circumferential groove 116 (e.g. V-shaped, modified V-shaped, U-shaped, modified U-shaped). The cylindrical-shaped center roller portion 112 can be of greater diameter compared with the centered cylindrical-shaped portion 115.

The exercise roller device 110 is provided with a pattern of grooves 117 as shown and different from the pattern of grooves compared to the exercised roller device 10 shown in FIG. 1. The grooves 117 are shown as being a pattern of connecting or interconnected grooves.

Method of Making Device

Figure 9:
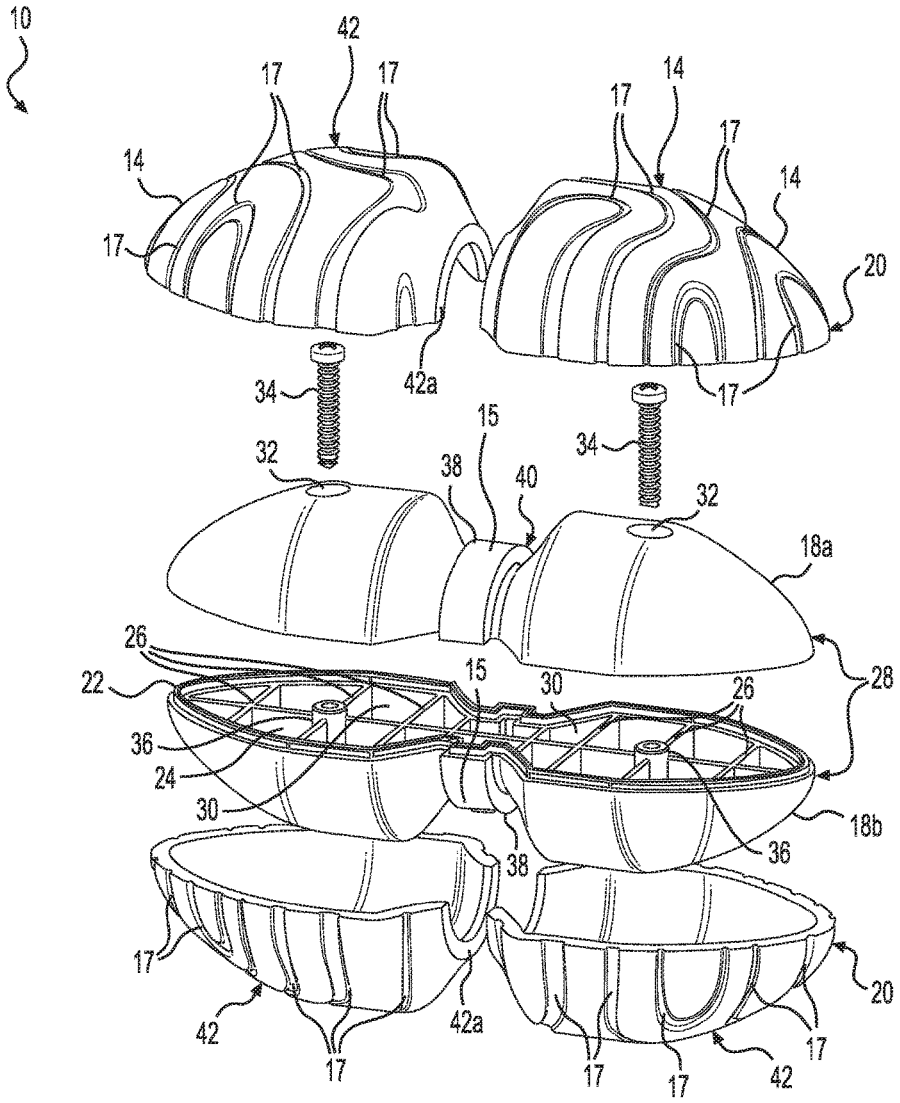
FIG. 9 is an exploded perspective view of the disassembled exercise roller device shown in FIG. 1, to illustrate its construction.

As shown in FIG. 9, the exercise roller device 10 can comprise an inner roller 18 and an outer roller 20.

The inner roller 18 comprises two (2) half inner roller portions 18*a*, 18*b* connected together. The roller portions 18*a*, 18*b* are molded (e.g. injection molded) and made of plastic material (e.g. nylon material).

The upper inner roller portion 18*a* fits over a peripheral flange 22 of the lower inner roller portion 18*b* for connecting the edges of the inner roller portions 18*a*, 18*b* together during assembly of the inner roller 18 and reinforcing the edges thereof in the assembled article.

The inner roller portions 18*a*, 18*b* have the same or similar inner reinforcing structure to be defined with reference to the inner roller portion 18*b*. As shown in FIG. 9, the inner roller portion 18*b* comprises a center longitudinal rib 24 connecting to multiple transverse ribs 26. The number of longitudinal ribs (e.g. one (1) longitudinal rib shown) can be decreased (i.e. none) or increased, and the number of transverse ribs can be decreased or increased (e.g. eight (8) shown). The ribs 24, 26 interconnect with each other (e.g. formed interconnected during molding), and also connect to and support the shell 28. The ribs 24, 26 and shell 28 define a plurality of cavities, voids, and/or cells 30 providing multiple hollow portions of the inner roller 18. This rib type construction reinforces the shell 28 of the inner roller 18 making the inner roller 18 substantially rigid, stronger, and more durable while reducing the weight and material required to make same.

The inner roller portion 18*a* is provided with molded recesses 32 in the surface thereof. The molded recesses includes a hole at the bottom of the recess (not shown) for accommodating the heads of screws 34 when the inner roller 18 is assembled together.

The inner roller portion 18*b* is provided with molded round bosses 36 each having a hole for receiving the free ends of the screws 34 to anchor same therein.

The inner roller portions 18*a*, 18*b* are provided with centered ridge halves 38 defining a circumferential ridge 40 when assembled together. The circumferential ridge 40 defines the center cylindrical portion 15 in the assembled exercise roller device 10.

The outer roller 20 comprises four (4) separate outer roller panels 42 to be supported (e.g. connected, attached, layered) on the assembled inner roller 18. The outer roller panels 38 are connected to the inner roller 18, for example, by adhesive and/or mechanical connection (e.g. fastening or coupling). The inner edges 42*a* of the outer roller panels 38 abut up against the side edges of the circumferential ridge 40, when assembled onto the inner roller 20 to provide a smooth seamless transition and outer surface of the exercise roller device 10.

Alternatively, the circumferential ridge 40 is eliminated, and the inner edges 42*a* are modified to abut against each other at the center of the exercise roller device 10, again providing a smooth seamless transition and outer surface of the exercise roller device 10.

The outer roller panels 42 are resiliently deformable, and, for example, are molded (e.g. injection molded) using plastic material (e.g. thermoplastic elastomer (TPE) material).

Alternatively to the above construction, after the inner roller 18 can be assembled, and then the outer roller 20 can be overmolded onto the inner roller 18 (e.g. by insert molded) to complete the assembly.

The exercise roller device 10 can be made by making the inner roller 18 and the outer roller 20. For example, the half portions of the inner roller 20 are injection molded from plastic material. The two half portions of the inner roller are then assembled together, and secured using the screws 34.

The outer roller panel portions 42 can be made, for example, by injections molding. The outer panel portions 42 can be a single layer or multiple layer of the same or different materials. For example, an inner panel of stiffer plastic material can be molded, and then a more resilient or softer outer panel or layer is overmolded on the inner panel (e.g. by insert molding). The made outer roller panel portions 42 can then be assembled onto the assembled inner roller 18 (e.g. by adhesive, taping, heat welding, mechanical fastening).

Alternatively, the inner roller 18 is assembled, and then the outer roller 18 is overmolded onto the inner roller 18 (e.g. by insert molding). As a further alternative, the inner roller 18 is injection molded as a unit or made from a perform or block of material (e.g. machined), and then fitted with outer roller panel portions 42, or overmolded with the outer panel 20.

Use

Figure 10:
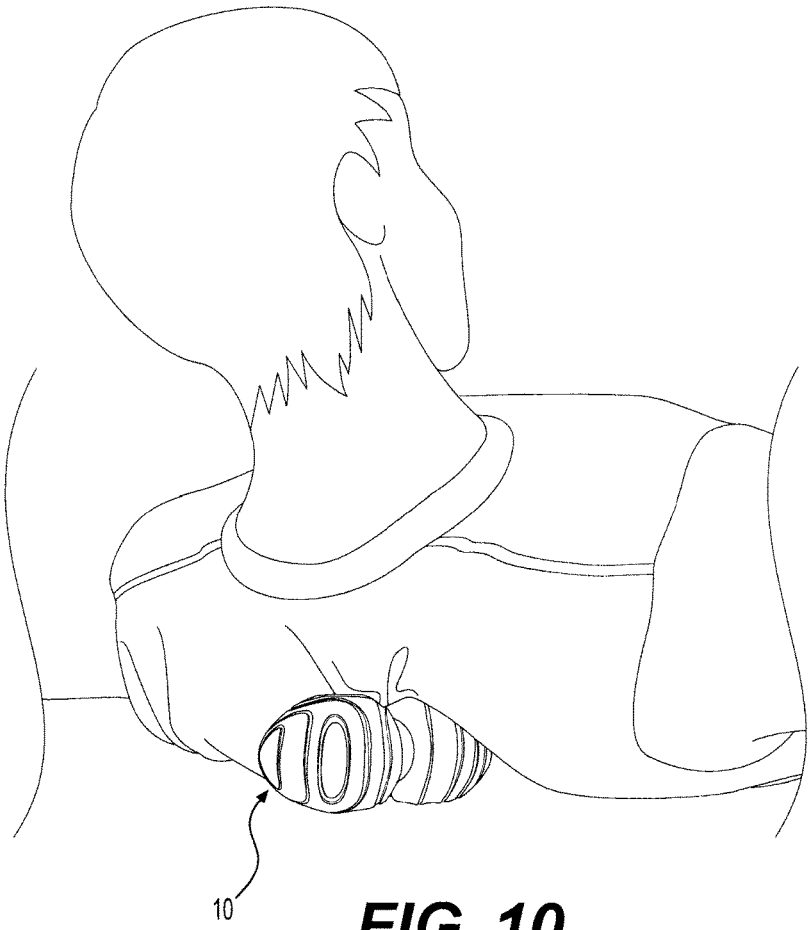
FIG. 10 is a diagrammatic view showing the exercise roller device shown in FIG. 1 positioned under the back between the shoulders of a user.

As shown in FIG. 10, the user places the exercise roller device 10 on the floor and lies on the device so that the device is centered on the user back and aligned with his or her spine as shown. The user then moved back and forth sideways to roll the exercise roller device between the floor and his or back. This exercise is performed with care, and limited physical activity.

I claim:

1. An exercise roller device, comprising:

an outer roller comprising:

a cylindrical-shaped center roller portion defining an outermost surface of the exercise roller device, the cylindrical-shaped center roller portion having a centered circumferential groove; and parabolic-shaped end roller portions each provided, respectively, at opposite ends of the cylindrical-shaped center roller portion, the parabolic-shaped end roller portions each having a vertex located on a center longitudinal axis of the exercise roller device; and an inner roller supporting the outer roller, the inner roller comprising parabolic-shaped end inner roller portions located at opposite ends of the inner roller, the parabolic-shaped end roller portions of the inner roller each having a vertex located on a center longitudinal axis of the exercise roller device.

2. The device according to claim 1, wherein the inner roller is substantially rigid or rigid and the outer roller is soft or resiliently deformable.

3. The device according to claim 1, where the outer roller comprises one or more outer roller panels connected to the inner roller.

4. The device according to claim 3, wherein the one or more outer roller panels are multiple outer roller panels.

5. The device according to claim 4, wherein the multiple panels are of the same size and shape.

6. The device according to claim 1, wherein the outer roller is overmolded onto the inner roller.

7. The device according to claim 1, wherein the inner roller comprises a centered circumferential ridge, and the outer roller comprises four (4) outer roller portions connecting to the inner roller and abutting the centered circumferential ridge.

8. The device according to claim 1, wherein the outer roller covers at least a portion of the inner roller.

9. The device according to claim 1, wherein the exercise roller device is a single integral unit when assembled with no moving parts.

10. The device according to claim 1, wherein the outer roller and inner roller are fixed relative to each other.

11. The device according to claim 1, wherein the outer roller is connected to the inner roller in a manner to prevent disconnection between the outer roller and the inner roller.

12. The device according to claim 1, wherein the exercise roller device is configured to prevent rotation between portions of the exercise device when assembled.

* * * * *